US007926258B1

(12) United States Patent
Burton et al.

(10) Patent No.: US 7,926,258 B1
(45) Date of Patent: Apr. 19, 2011

(54) ADVANCED PULSED PLASMA THRUSTER WITH HIGH ELECTROMAGNETIC THRUST

(75) Inventors: Rodney L. Burton, Champaign, IL (US); Gabriel F. Benavides, Champaign, IL (US); Julia K. Laystrom, Champaign, IL (US)

(73) Assignee: CU Aerospace, LLC, Champaign, IL (US)

( * ) Notice: Subject to any disclaimer, the term of this patent is extended or adjusted under 35 U.S.C. 154(b) by 480 days.

(21) Appl. No.: 12/177,244

(22) Filed: Jul. 22, 2008

Related U.S. Application Data

(60) Division of application No. 11/188,536, filed on Jul. 25, 2005, now Pat. No. 7,530,219, which is a continuation-in-part of application No. 10/457,659, filed on Jun. 9, 2003, now abandoned.

(60) Provisional application No. 60/389,080, filed on Jun. 14, 2002.

(51) Int. Cl.
*F03H 1/00* (2006.01)
*H05H 1/00* (2006.01)

(52) U.S. Cl. ..... 60/202; 315/111.21

(58) Field of Classification Search ..... 60/202, 60/203.1; 244/171.1; 313/359.1, 360.1, 313/361.1, 362.1, 363.1; 315/111.21, 111.31, 315/111.41, 111.51, 111.61, 111.71
See application file for complete search history.

(56) References Cited

U.S. PATENT DOCUMENTS

| | | | | |
|---|---|---|---|---|
| 3,159,966 | A * | 12/1964 | Curtis | 60/202 |
| 3,603,089 | A * | 9/1971 | Esker et al. | 60/203.1 |
| 4,233,537 | A * | 11/1980 | Limpaecher | 313/231.31 |
| 4,821,509 | A * | 4/1989 | Burton et al. | 60/203.1 |
| 5,111,656 | A * | 5/1992 | Simon et al. | 60/203.1 |
| 5,924,278 | A * | 7/1999 | Burton et al. | 60/203.1 |
| 6,075,321 | A * | 6/2000 | Hruby | 315/111.91 |
| 6,216,445 | B1 * | 4/2001 | Byers et al. | 60/203.1 |
| 6,300,720 | B1 * | 10/2001 | Birx | 315/111.21 |
| 6,318,069 | B1 * | 11/2001 | Falce et al. | 60/202 |
| 6,336,318 | B1 * | 1/2002 | Falce et al. | 60/202 |
| 6,378,290 | B1 * | 4/2002 | Killinger et al. | 60/202 |
| 6,449,941 | B1 * | 9/2002 | Warboys et al. | 60/202 |
| 7,530,219 | B1 * | 5/2009 | Burton et al. | 60/203.1 |

FOREIGN PATENT DOCUMENTS

SU 270928 A * 5/1970

* cited by examiner

*Primary Examiner* — Joshua J Michener
*Assistant Examiner* — Joseph W Sanderson
(74) *Attorney, Agent, or Firm* — Adam K. Sacharoff; Much Shelist

(57) ABSTRACT

A pulsed plasma thruster provides for an advanced light-weight design with solid propellant and predominately electromagnetic thrust in a coaxial geometry. Electromagnetic forces are generated in a plasma by current flowing from a small central electrode to an electrically conducting diverging nozzle electrode. The thruster employs a series of electric current pulses of limited duration and varying frequency between the pair of electrodes creating a series of electric arcs. The electric arcs pass over a propellant surface located between the electrodes, forming a plasma, which is then exhausted from the device to produce thrust. The thruster maintains a low plasma resistance and cavity pressure, which in turn yields strong electromagnetic body forces, resulting in a high efficiency and consistent pulse-to-pulse performance.

7 Claims, 6 Drawing Sheets

ADVANCED PULSED PLASMA THRUSTER WITH HIGH ELECTROMAGNETIC THRUST

RELATED APPLICATIONS

The present invention is a Divisional Application of U.S. patent application Ser. No. 11/188,356, which is a Continuation In Part of U.S. patent application Ser. No. 10/457,659 filed on Jun. 9, 2003, which claims priority to Provisional Application Ser. No. 60/389,080 filed Jun. 14, 2002.

FIELD OF THE INVENTION

The present invention is directed to a subset of electric propulsion, pulsed plasma thrusters, for maneuvering of a mass in microgravity.

BACKGROUND OF THE INVENTION

A pulsed plasma thruster is typically used to maneuver spacecraft and satellites in microgravity. The thruster employs a series of electric current pulses of limited duration and varying frequency between a pair of electrodes creating a series of electric arcs. The electric arcs pass over the surface of a propellant, increasing the surface temperature of the propellant, thereby forming an ionized gas, known as a plasma. The plasma is then exhausted from the device to produce thrust.

The two primary classifications of pulsed plasma thrusters are electrothermal and electromagnetic. In the case of an electrothermal thruster, the heating and/or ablation process results in a high chamber pressure accompanied by high plasma resistance, exhausting the plasma from the thruster by supersonic gas expansion. Alternatively, in the case of an electromagnetic thruster, chamber pressures and plasma resistance remain low, helping to facilitate high ionization fractions. Within an electromagnetic thruster, the flow of current between the electrodes induces electric and magnetic fields resulting in electromagnetic body forces which accelerate the ionized particles from the thruster. In comparison with electrothermal thrusters, electromagnetic thrusters are phenomenologically more complex. They are also considerably more difficult to model analytically and technologically more difficult to implement.

More specifically, electrothermal pulsed plasma thrusters may be characterized by high chamber pressures, a high plasma resistance, and substantial temperature and density gradients, typically followed with supersonic gas expansion through an exhausting insulating nozzle. The nozzle is generally insulating to reduce heat loss in the nozzle and encourage a modest amount of electromagnetic thrust. The high plasma resistance promotes efficient transfer of the capacitively stored energy into the plasma.

On the other hand, electromagnetic pulsed plasma thrusters may be characterized by low chamber pressures, a low plasma resistance, high ionization fractions, and pulsed electric arcs which traverse the region between the electrodes in a manner substantially perpendicular to the flow of the exhausting plasma. In the case of an electromagnetic pulsed plasma thruster, the addition of a supersonic nozzle usually provides little to no benefit since the low chamber pressures do not facilitate significant supersonic gas expansion. The primary contribution to the thrust is produced by the current's self-induced electromagnetic body forces. The present invention has found that a conductive nozzle, though ineffective at encouraging supersonic gas expansion due to low chamber pressures, aids in producing significantly greater electromagnetic body forces. Furthermore, a low plasma resistance promotes stronger electromagnetic body forces and in turn greater thrust.

Electrothermal and electromagnetic pulsed plasma thrusters may be further categorized as either parallel-plate or coaxial. In a parallel-plate configuration, the electric arc passes between a pair of electrodes that are situated parallel to the direction of the plasma flow as shown in FIG. 1. In a coaxial configuration, the electric arc passes between a centrally located electrode and an annular electrode as shown in FIG. 2. Generally, electromagnetic pulsed plasma thrusters utilize the parallel-plate configuration. In order to maximize electromagnetic body forces, the current path is necessarily substantially perpendicular to the flow of ionized particles. As FIG. 1 illustrates, the geometry of a parallel-plate design inherently provides the optimal current path relative to the flow of ionized particles. While significantly more difficult to achieve with a coaxial configuration, the present invention's geometry manages to encourage a current path substantially perpendicular to the flow of ionized particles in a coaxial configuration.

Prior art pulsed thruster systems can be found in U.S. Pat. Nos. 6,295,804 and 5,924,278 to common inventor Burton. Said systems utilize a high chamber pressure, accompanied by a high plasma resistance, to accelerate the plasma, thus classifying the systems as predominantly electrothermal. The systems accelerate the plasma through an insulating nozzle, facilitating supersonic gas expansion. The systems expel the plasma from the cavity in a flow path that is substantially parallel to the electric arc and current path within the cavity.

The present invention, predominantly electromagnetic, improves upon the prior art by maintaining a low plasma resistance and in turn producing strong electromagnetic body forces, resulting in significantly higher efficiencies and more consistent pulse-to-pulse performance. While the present invention utilizes a diverging nozzle, the nozzle is necessarily conducting, unlike to the aforementioned thrusters. Though the conducting nozzle enables some supersonic gas expansion, the major benefit is that the nozzle exploits electromagnetic phenomena to further accelerate the plasma. The electric arc and current path is also necessarily substantially perpendicular to the flow path of the plasma to facilitate electromagnetic acceleration.

SUMMARY OF THE INVENTION

The present invention provides for an advanced lightweight pulsed plasma thruster with high electromagnetic thrust in a coaxial geometry. The thruster includes a plasma generating section that has a centrally located electrode, radially fed propellant bars and a conducting annular electrode. The propellant material exposed to the electric discharge forms an ionized gas as a result of being heated by the electric arc. The thruster also includes an exhaust section having a conducting cavity diverging away from the centrally located electrode. The thruster is further connected to an electric pulse power supply unit such that the centrally located electrode and the annular electrode generate short-duration axisymmetric electric arcs with a current path across the surface of the propellant, such that the propellant material being heated by the electric arcs produces ionized gas in the plasma generating section. The percentage of ionization is significantly higher, and the plasma resistance is significantly lower, than previous thrusters of this type. The ionized gas is expelled from the thruster at high velocity to produce a thrust pulse. A sequence of thrust pulses, averaged over time, produce an average thrust for maneuvering a mass in microgravity. The thrust produced by the pulsed plasma thruster has an electromagnetic thrust component which is on the order of 60% or larger of the total thrust. The plasma resistance is less than 15 milliohms.

In addition, a low-inductance parallel-plate or coaxial transmission line connects the thruster electrodes to the pulsed electric power supply unit. The design of the low inductance transmission line provides for pulses with higher peak currents and fewer oscillations, which in turn induces a lower plasma resistance in the thruster, yielding greater electromagnetic thrust.

In one embodiment of the present invention a pulsed plasma thruster includes:

a cylindrical plasma generating section having an annular cross-section with at least one propellant feed opening;

an exhaust section having a minimum radius and a diverging section that is located downstream of the plasma generating section and having a wall that is substantially electrically conducting to form an annular electrode and nozzle;

a central electrode, mounted on a conductive shaft, being centrally located within the plasma generating section;

an insulating member secured to and separating the central electrode from the annular electrode;

an insulating sleeve positioned about the conductive shaft and secured to the insulating member;

at least one solid propellant bar that forms an ionized gas as a result of being heated, a first end of the propellant bar being radially fed through the at least one opening of the plasma generating section;

a means for initiating an electric arc between the central electrode and the annular electrode to generate an electric arc having a current path across a surface portion of the propellant bar, such that propellant material is heated to produce ionized gas, which is electromagnetically expelled from the thruster at high velocity to produce thrust.

The thruster may also include a minimum annular electrode radius defined by the plasma generating section that is the minimum diameter of the exhaust section which enables a low pressure and a low plasma resistance within the exhaust section to provide thrust with an increased electromagnetic component during the generation of the electric arc.

The thruster may also include a central electrode that is conical in shape to increase the electromagnetic thrust component.

The thruster may further include a ratio between the minimum radius of the nozzle and the central electrode radius that is between 3.0 and 10.0 to provide thrust with an electromagnetic thrust component that is greater than an electrothermal thrust component.

The thruster may also include an insulating member that separates the central electrode from the annular electrode so as to maintain a non-conductive path to protect against electrodes shorting as a result of carbon deposits on the cavity surfaces.

Numerous advantages and features of the invention will become readily apparent from the following detailed description of the invention and the embodiments thereof, and from the accompanying drawings.

BRIEF DESCRIPTION OF THE DRAWINGS

Better understanding of the aforementioned invention may be had by referencing the accompanying drawings, wherein.

DETAILED DESCRIPTION OF THE EMBODIMENTS

Figure 1:
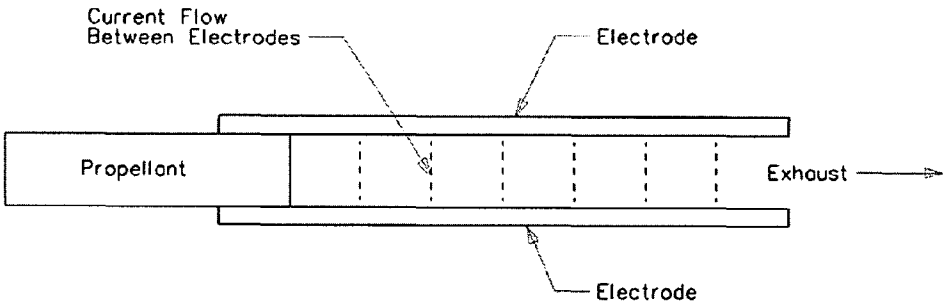
FIG. 1 is a simplified representation of a parallel-plate pulsed plasma thruster.
Figure 2:
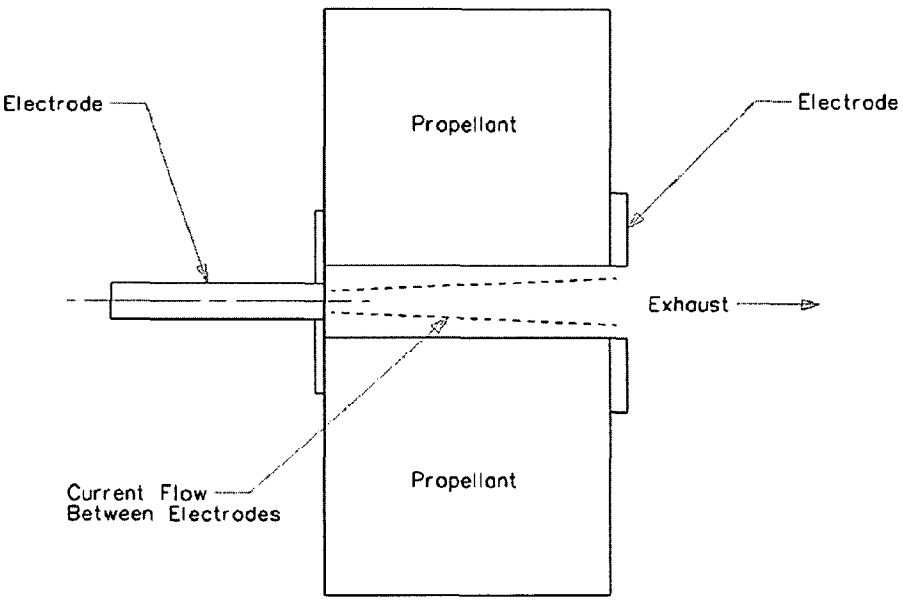
FIG. 2 is a simplified representation of a coaxial pulsed plasma thruster.

While the invention is susceptible to embodiments in many different forms, the preferred embodiments of the present invention are shown in the drawings (FIGS. 3-7) and will be described in detail herein. It should be understood, however, that the present disclosure is to be considered an exemplification of the principles of the invention and is not intended to limit the spirit or scope of the invention and/or the embodiments illustrated. It is to be understood that no limitation with respect to the specific methods and apparatus illustrated herein is intended or should be inferred.

Figure 3:
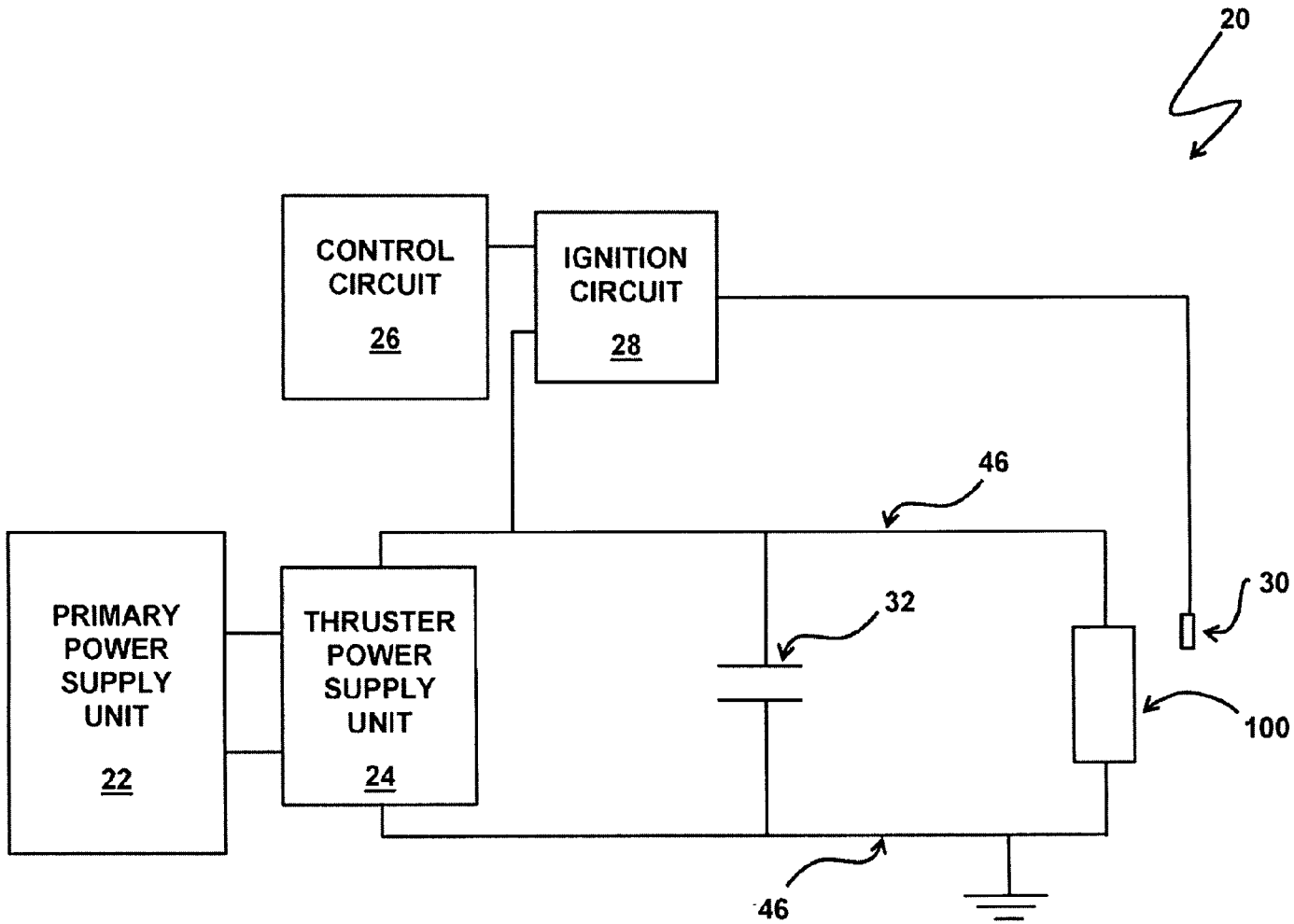
FIG. 3 is a system diagram of the present invention.
Figure 4:
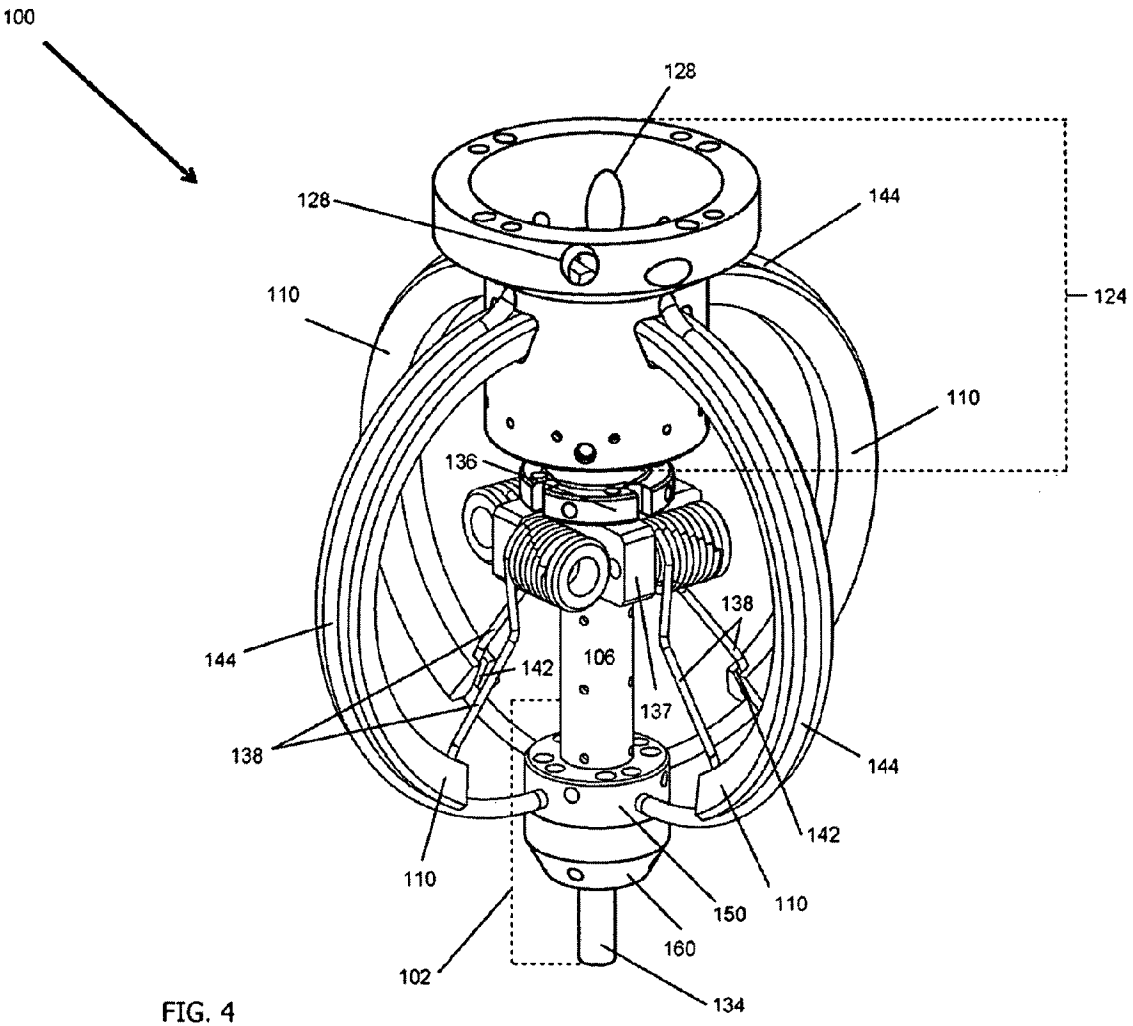
FIG. 4 is a perspective view of the present invention.
Figure 5:
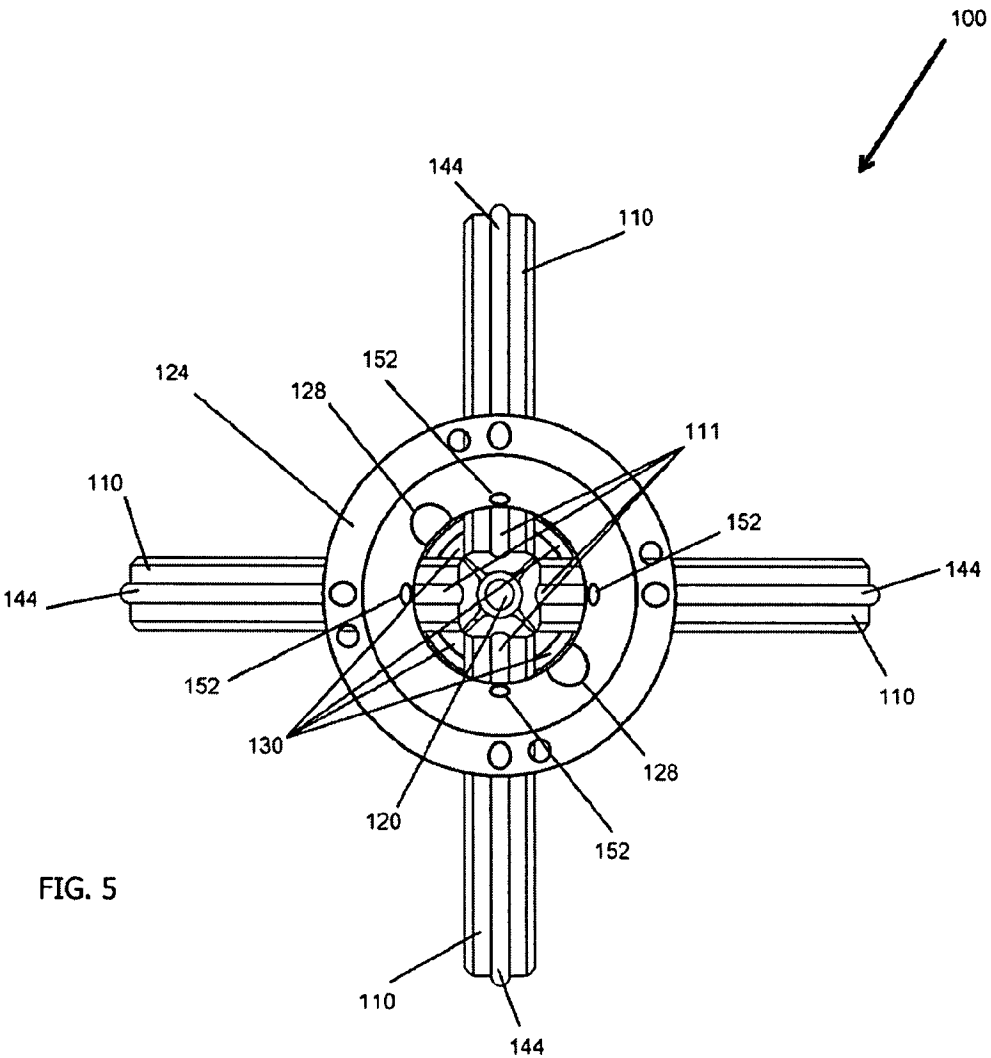
FIG. 5 is an axial view of the present invention.
Figure 6:
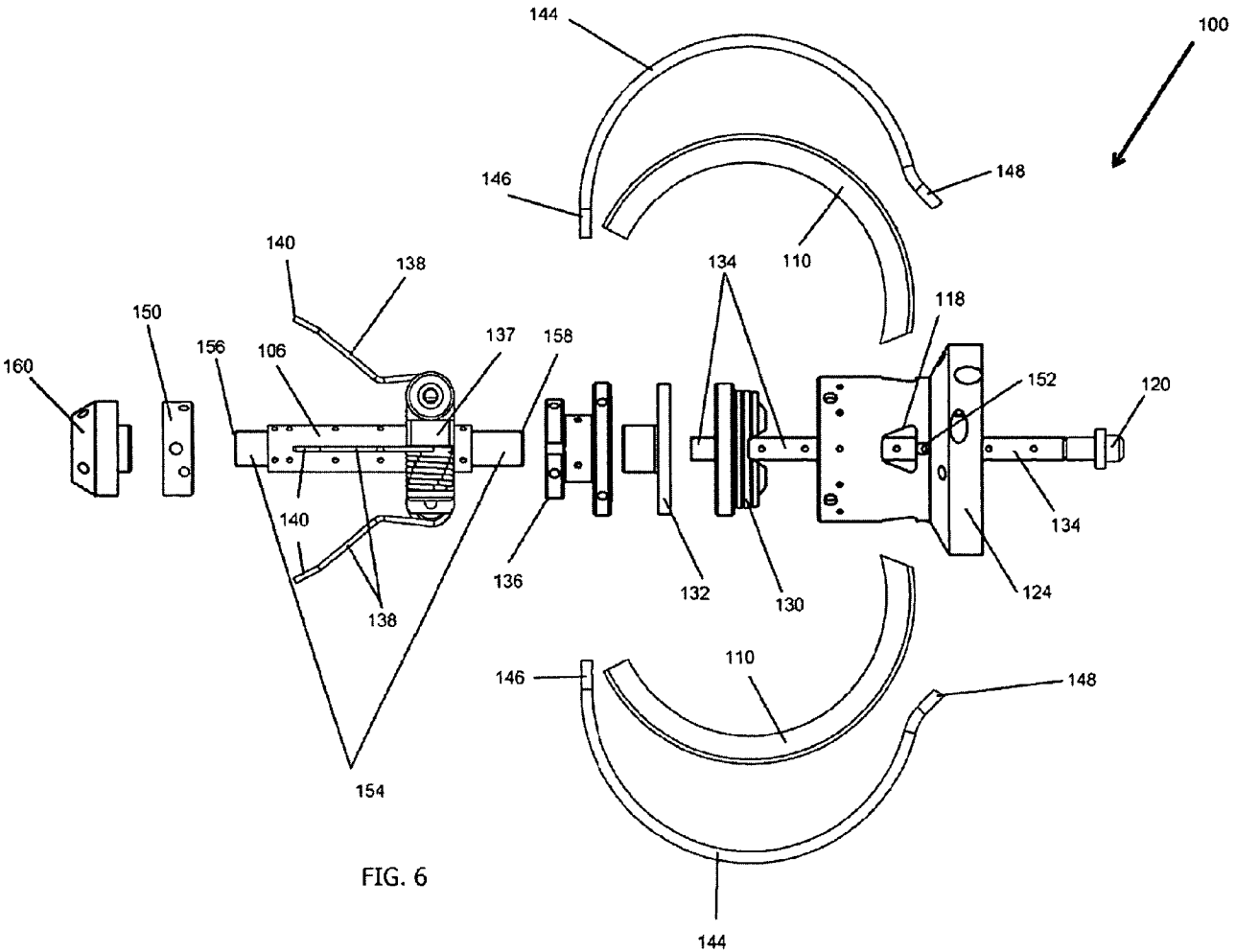
FIG. 6 is an exploded view of the present invention.
Figure 7:
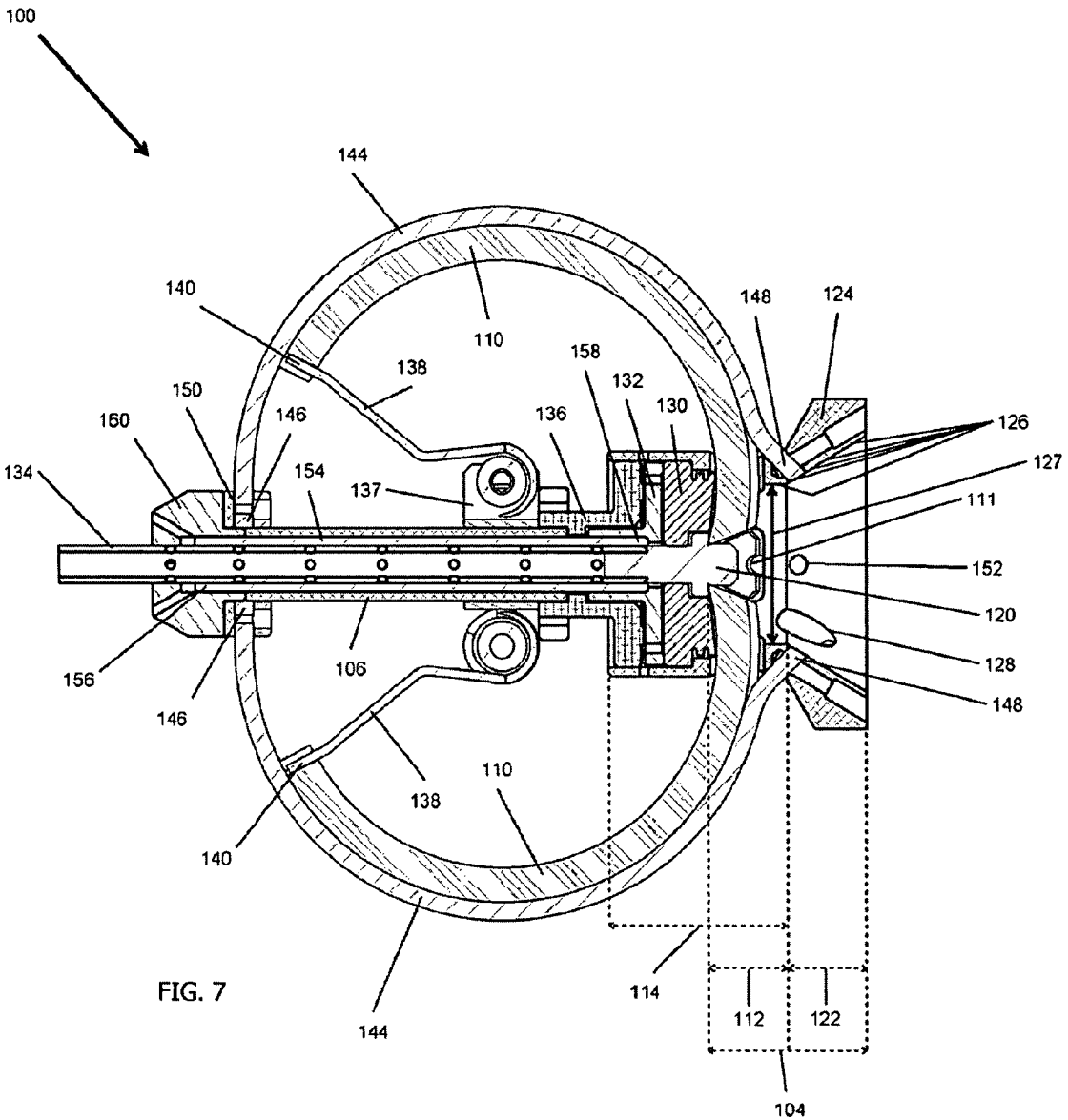
FIG. 7 is a cross-sectional view of the present invention.

A schematic of a pulsed thruster system 20, in accordance to the present invention, is shown in FIG. 3. The system 20 includes a primary power supply unit 22, a thruster power supply unit 24, a control circuit 26, an ignition circuit 28, a spark generating device 30, a capacitor 32, and a thruster 100. The primary power supply 22 is coupled to the thruster power supply 24, which in turn is coupled to the ignition circuit 28 and selectively coupled to the capacitor 32. The ignition circuit 28 is coupled to the spark generating device 30, and receives commands from the control circuit 26. The capacitor 32 is coupled across the thruster 100 via low inductance transmission lines 46.

Referring now to FIGS. 4-7, the pulsed plasma thruster 100 includes an electrical connection region 102 for establishing electrical connections to the transmission lines 46 and a plasma generating and exhaust region 104. The plasma generating and exhaust region 104 generates plasma from a propellant and exhausts the plasma at a high velocity to generate thrust. Positioned between the electrical connecting region 102 and the plasma generating and exhaust region 104 is an electrically conducting structural tube 106, which accommodates a spring mount 137. The spring mount 137 has springs 138 attached to it that separately feed multiple solid propellant bars 110 into a plasma generating section 112. The solid propellant bars 110 are curved, permitting a more compact and efficient design than the common straight fuel bar. As the propellant bars 110 are heated, the spring mount 137 maintains a constant feeding into the plasma generating section 112.

The plasma generating and exhaust region 104 is defined by a circular body 114 having an annular cross-section. The circular body 114 has multiple propellant feed openings 118 aligned radially with the center of the plasma generating section 112 for which multiple solid propellant bars 110 are fed towards a central electrode 120. The central electrode 120 is positioned at the center of the circular body 114.

The circular body 114 further includes an exhaust section 122 with a conductive interior cavity wall 126 that diverges radially away from the plasma generating section 112 to define a diverging nozzle. The circular body 114 is made of an electrically conductive material, such that it forms the annular electrode. The exhaust section 122 also includes oblique ports 128 for receiving spark generating devices (not shown).

The interior cavity wall 126 has a bottom portion referred to as the minimum annular electrode radius 127 that forms the inlet of the diverging nozzle. The minimum annular electrode radius 127 is in close proximity to the plasma generating section 122 and more importantly in close proximity to the central electrode 120. The radius ratio between the minimum annular electrode radius 127 and the central electrode 120 is a critical element in creating the higher electromagnetic thrust component and is further explained below.

Internally, the plasma generating section 112 houses various components that include a cavity insulator 130 that separates the central electrode 120 from the annular electrode 124 and a forward insulator 132 that mates the cavity insulator 130 to an insulating sleeve 154 that maintains the insulation around a central conductive shaft 134. The central conductive shaft 134 sustains the electrical current from the capacitor 32 to the central electrode 120. The plasma generating section 112 is secured to the structural tube 106 by a forward conducting mount 136.

As mentioned above, the structural tube 106 accommodates the spring mount 137 which slides onto the structural tube 106 and is bolted to the forward conducting mount 136. The springs 138 attached to the spring mount 137 include one end 140 that is positioned in a notch 142 located in the bottom portion of the propellant bars 110. The propellant bars 110, preferably TEFLON, are guided into propellant feed openings 118 by curved propellant support rods 144. The propellant support rods 144 have one end 146 secured to a rear conductor mount 150 and the other end 148 secured to apertures 152 located above the propellant feed openings 118 in the circular body 114 and are positioned within grooves 111 defined on the propellant bars 110.

The structural tube 106 is constructed from a conductive material and includes an internal insulating sleeve 154, which has protruding ends 156 and 158. The internal insulating sleeve 154 is hollow to accommodate the conductive shaft 134. One end 158 of the insulating sleeve 154 is fitted through the forward conducting mount 136 and into the forward insulator 132, while the other end 156 is fitted within the rear insulator cap 160 such that the conductive shaft 134 and the central electrode 120 are completely insulated from the annular electrode 124 and outside conductive nature of the thruster 100. The rear conductor mount 150 is positioned about the exterior surface of the structural tube 106, with the rear insulator cap 160 abutting the rear conductor mount 150 to maintain the insulation between the two electrodes.

In operation, the primary power supply unit 22 provides power to the thruster power supply unit 24, which charges the capacitor 32. The capacitor 32, in turn, applies a voltage across the thruster 100, (between the central electrode 120 and annular electrode 124). In accordance with a signal received from the control circuit 26, the ignition circuit 28 fires the spark generating devices 30. The firing of the spark generating devices 30 sprays ionized particles into the plasma generating section 112 allowing current to flow between the central electrode 120 and the annular electrode 124 completing the circuit. As the arc heats the surface of the propellant bars 110, ionized gas or plasma forms. The arc further induces a strong electromagnetic field, accelerating the plasma due to electromagnetic body forces, in turn creating thrust.

The electromagnetic thrust fraction, β, of the present invention is designed to be significantly greater than prior coaxial pulsed plasma thrusters. The electromagnetic thrust fraction, β, is defined as the electromagnetic component of the total thrust, $T_{EM}$, divided by the total thrust. The improvement is primarily a direct result of an increased current density (Amperes per square meter) between the electrodes and a higher peak current. The higher peak current is a direct result of decreasing the plasma resistance between the electrodes and lowering the circuit inductance. The analytical relationship between the instantaneous electromagnetic thrust component, $T_{EM}$, and time-varying current, I, is:

$$T_{EM} = \left(\frac{\mu_o}{4\pi}\right)\left[\ln\left(\frac{r_a}{r_c}\right) + C\right]I^2 = \frac{1}{2}L'I^2$$

where $\mu_o$ is the permeability of free space, $r_a$ is the radius of the annular electrode 124, $r_c$ is the radius of the central electrode 120, C is a constant that ranges from 0 to 0.75 based on the electrode geometry, and L' is the inductance gradient (Henries per meter). The analytical relationship between the instantaneous electromagnetic thrust component, $T_{EM}$, and the plasma resistance is given by $$T_{EM} = \frac{P\left(\frac{\mu_o}{4\pi}\right)\left[\ln\left(\frac{r_a}{r_c}\right) + C\right]}{R}$$

where P is the instantaneous pulse power and R is the plasma resistance. Notice that the instantaneous electromagnetic thrust is inversely proportional to the plasma resistance, demonstrating the enormous value of any design improvements that reduce plasma resistance.

More specifically, the present invention achieves high system performance through the following: (1) a large electrode radius ratio ($r_a/r_c$) provides high electromagnetic thrust through a high inductance gradient; (2) a central electrode 120 with a conical tip contributes to a high inductance gradient; (3) a conductive conical exhaust section 122 permits the arc to travel from the minimum annular electrode radius outward to a greater radius, providing an average increase in the radius ratio; (4) the geometry of the cavity insulator 130 provides protection against electrode shorting due to carbon deposits on cavity surfaces; (5) the geometry of the propellant 110 within the plasma generating section 112 aids in maintaining a low plasma resistance; (6) a high-capacitance, low internal resistance capacitor 32 reduces current oscillations (ringing) and reduces peak voltage; (7) an annular electrode 124 with significant surface area enables low electrode erosion; (8) a decreased annular electrode erosion permits the use of lightweight metals in its construction, decreasing the overall system mass; (9) a coaxial electrode arrangement with a radial propellant feed system promotes a constant cavity geometry; (10) a nearly constant cavity geometry and a substantially electromagnetic contribution to the thrust enable repeatable pulse-to-pulse performance; (11) an electrically conducting annular electrode resulting in a large annular electrode surface area to create a small average current density at the cavity wall to allow the annular electrode to be constructed from low density materials such as an aluminum alloy.

In a first exemplary embodiment of the present invention, the total mass of the thruster 100 is 298 grams including 70 grams of useable TEFLON propellant. The radius of the central electrode 120 is 3.8 millimeters and the minimum annular electrode radius 127 is 14 millimeters resulting in a ratio, $r_a/r_c$, equal to 3.68. The thruster operates typically at energy levels of 40-70 Joules per pulse, an average power level of 85 Watts, and a total capacitance of 82 microfarads. The results of initial testing provided an average thrust of 1.7 milli-Newtons, an average specific impulse, $I_{sp}$, of 1374 seconds, a thruster efficiency of 14 percent, a total circuit resistance of 15 milli-Ohms and an electromagnetic thrust fraction, β being 66 percent of the total thrust.

In a second exemplary embodiment of the present invention, the total mass of the thruster 100 is 400 grams including 75 grams of useable TEFLON propellant. The total capacitance of the capacitors is 80 microfarads. The thruster operates at 100 Watts with an efficiency of 16 percent and an average $I_{sp}$ of 1350 seconds with a total impulse of 990 Newton-seconds. Testing demonstrated a thrust of approximately 2.0 milli-Newtons where 1.2 milli-Newtons is electromagnetic, resulting in a β of 60 percent.

In both the first and second exemplary embodiments, the thruster proved to have highly repeatable pulse-to-pulse performance. The thrust and peak current both demonstrate less than 2% variation over long durations during initial testing.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred.

We claim:

1. A pulsed plasma thruster comprising:

a plasma generating section including a centrally located electrode, the plasma generating section having a coaxial geometry and the centrally located electrode having a radius defined thereby;

an exhaust section having a cavity wall and a minimum annular electrode radius, the cavity wall being substantially electrically conducting to form an annular electrode, the minimum annular electrode radius of the annular electrode having a radius defined thereby;

a propellant material that forms an ionized gas as a result of being heated;

an electric power supply unit connected to both the centrally located electrode and the annular electrode to generate an electric arc having a current path across a surface portion of the propellant, such that the propellant material being heated by the electric arc produces the ionized gas, which is expelled from the thruster at high velocity to produce thrust; and wherein a ratio defined between the minimum radius of the annular electrode and the radius of the centrally located electrode is at least 3.0 to provide thrust with an electromagnetic thrust component that is greater than the electrothermal thrust component.

2. The thruster of claim 1 further comprising:

wherein the propellant material is formed into at least one curved solid propellant bar, each propellant bar being supported on a rod that has a first end terminating about the plasma generating section and a second end terminating about an electrically conducting structural tube defined to support the centrally located electrode, and corresponding to each curved propellant bar is a spring mount assembly secured externally about the electrically conducting structural tube and applying a force on said corresponding curved propellant bar to radially feed said corresponding curved propellant bar into the plasma generating section.

3. The thruster of claim 1, wherein the central electrode has a conical tip.

4. The thruster according to claim 1, wherein the central electrode includes a conical tip to increase an inductance gradient to produce thrust with an electromagnetic thrust component larger than an electrothermal thrust component.

5. The thruster according to claim 1, wherein the electrically conducting exhaust section diverges away from the centrally located electrode forming a nozzle.

6. The thruster according to claim 1 further comprising a low inductance transmission line from the electric power supply unit to the central electrode and annular electrode to create pulses with high peak currents and fewer oscillations inducing lower plasma resistance in the thruster to produce thrust with an electromagnetic thrust component larger than the electrothermal thrust component.

7. The thruster according to claim 1, wherein the annular electrode is constructed from low density materials, including but not limited to aluminum alloy.

* * * * *